US009218773B2

(12) United States Patent
Sun et al.

(10) Patent No.: US 9,218,773 B2
(45) Date of Patent: Dec. 22, 2015

(54) METHOD AND DRIVING APPARATUS FOR OUTPUTTING DRIVING SIGNAL TO DRIVE ELECTRO-PHORETIC DISPLAY

(71) Applicant: SiPix Technology Inc., Taoyuan County (TW)

(72) Inventors: Wei-Min Sun, Taipei (TW); Chi-Mao Hung, Hsinchu (TW); Chih-Yuan Hsu, Taipei (TW); Yan-Liang Wu, Kaohsiung (TW); Pei-Lin Tien, Taichung (TW)

(73) Assignee: SiPix Technology Inc., Taoyuan (TW)

( * ) Notice: Subject to any disclaimer, the term of this patent is extended or adjusted under 35 U.S.C. 154(b) by 205 days.

(21) Appl. No.: 13/743,344

(22) Filed: Jan. 17, 2013

(65) Prior Publication Data

US 2014/0198088 A1 Jul. 17, 2014

(51) Int. Cl.
*G09G 3/34* (2006.01)

(52) U.S. Cl.
CPC ..... *G09G 3/344* (2013.01); *G09G 2310/0254* (2013.01); *G09G 2320/041* (2013.01)

(58) Field of Classification Search
CPC ..... G09G 3/3433
See application file for complete search history.

(56) References Cited

U.S. PATENT DOCUMENTS 7,557,960 B2 * 7/2009 Ishida et al. ..... 345/589
2013/0342107 A1 * 12/2013 Haacke et al. ..... 315/118

* cited by examiner

*Primary Examiner* — Waseem Moorad
(74) *Attorney, Agent, or Firm* — Jianq Chyun IP Office

(57) ABSTRACT

The present invention provides a driving apparatus, the driving apparatus is used for outputting a driving signal to drive an electro-phoretic display, and the driving apparatus includes a driving signal generator, a temperature sensor, and a selector. The driving signal generator generates a plurality of periodic alternative current signals and a plurality of direct current signals. The temperature sensor generates a temperature parameter by sensing an environment temperature. The selector is coupled to the driving signal generator and the temperature sensor. The selector selects one of the periodic alternative current signals or one of the direct current signals as the driving signal according to the temperature parameter.

14 Claims, 3 Drawing Sheets

METHOD AND DRIVING APPARATUS FOR OUTPUTTING DRIVING SIGNAL TO DRIVE ELECTRO-PHORETIC DISPLAY

BACKGROUND OF THE INVENTION

1. Field of Invention

The present invention generally relates to an apparatus for generating a driving signal to drive an electro-phoretic display (EPD), and more particularly to the apparatus for generating a common voltage for the EPD.

2. Description of Prior Art

In conventional driving structure, a common voltage is necessary for driving an electro-phoretic display (EPD). The common voltage can be set to be a direct current (DC) signal or an alternating current (AC) signal. Please notice here, in the conventional EPD, once the common voltage is set to be the DC voltage signal or the AC voltage signal, the style of the common voltage can not be changed when the EPD is operated. That is, the conventional EPD is driven by the common voltage in a fix style regardless the environment temperature. In this condition, when the conventional EPD is used in a place with related low environment temperature, a driving time is increased, and the performance of the conventional EPD is reduced correspondingly.

SUMMARY OF THE INVENTION

The present invention provides a driving apparatus for increasing a performance of an electro-phoretic display (EPD)

The present invention also provides a method for outputting a driving signal to drive an EPD, and the performance of the EPD is increased correspondingly.

The present invention provides a driving apparatus, the driving apparatus is used for outputting a driving signal to drive an electro-phoretic display, and the driving apparatus includes a driving signal generator, a temperature sensor, and a selector. The driving signal generator generates a plurality of periodic alternative current signals and a plurality of direct current signals. The temperature sensor generates a temperature parameter by sensing an environment temperature. The selector is coupled to the driving signal generator and the temperature sensor. The selector selects one of the periodic alternative current signals or one of the direct current signals as the driving signal according to the temperature parameter.

The present invention also provides a method for generating a driving signal to drive an electro-phoretic display. The steps of the method includes: generating a plurality of periodic alternative current signals and a plurality of direct current signals; generating a temperature parameter by sensing an environment temperature; and selecting one of the periodic alternative current signals or one of the direct current signals as the driving signal according to the temperature parameter.

According to the above descriptions, in the invention, the driving signal is generated by selecting one of the direct current signals or one of the periodic alternative current signals according to the environment temperature. That is, the style of the driving signal can be dynamically changed during the EPD is operating, and a better style of the driving signal can be selected according to the environment temperature for increasing the performance of the EPD.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
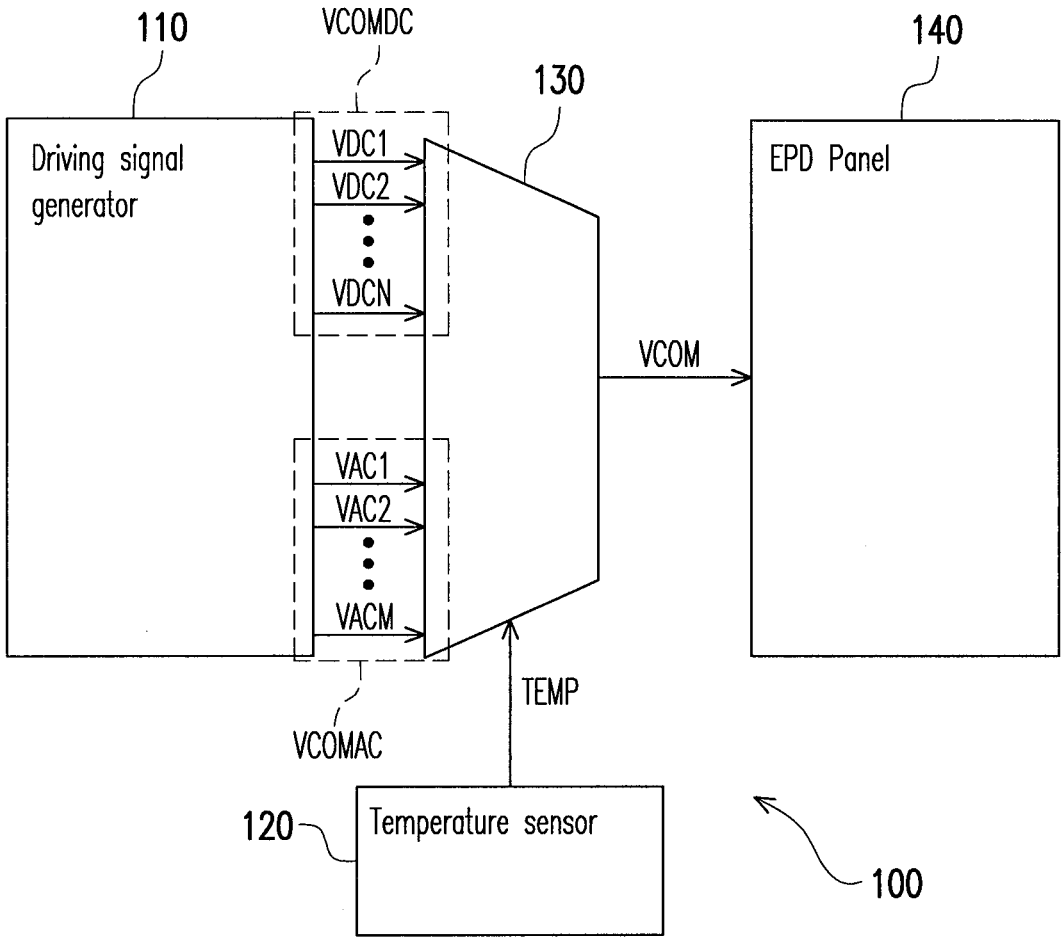
FIG. 1 is a block diagram of a driving apparatus 100 according to an embodiment of the present invention.

Reference will now be made in detail to the present preferred embodiment of the invention, examples of which are illustrated in the accompanying drawings. Wherever possible, the same reference numbers are used in the drawings and the description to refer to the same or like parts.

Referring to FIG. 1, FIG. 1 is a block diagram of a driving apparatus 100 according to an embodiment of the present invention. The driving apparatus 100 includes a driving signal generator 110, a temperature sensor 120 and a selector 130. The driving signal generator 110 generates a plurality of periodic alternative current signals VAC1-VACM and a plurality of direct current signals VDC1-VDCN. The temperature sensor 120 is used to sense an environment temperature and generates a temperature parameter TEMP accordingly. The selector 130 is coupled to the driving signal generator 110 and the temperature sensor 120. The selector 130 receives the periodic alternative current signals VAC1-VACM and the direct current signals VDC1-VDCN, and further receives the temperature parameter TEMP. The selector 130 selects one of the periodic alternative current signals VAC1-VACM or one of the direct current signals VDC1-VDCN as the driving signal VCOM according to the temperature parameter TEMP, wherein, the driving signal VCOM may be a common voltage for the EPD panel 140.

In detail, the driving signal generator 110 generates the periodic alternative current signals VAC1-VACM and the direct current signals VDC1-VDCN. The periodic alternative current signals VAC1-VACM may be arranged into a group VCOMAC, and the direct current signals VDC1-VDCN may be arranged into another group VCOMDC. Both the periodic alternative current signals VAC1-VACM and the direct current signals VDC1-VDCN are transported to the selector 130. The selector 130 further receives the temperature parameter TEMP. The selector 130 generates the driving signal VCOM from the group VCOMDC or VCOMAC according to the temperature parameter TEMP. For example, the selector 130 judges the temperature parameter TEMP is larger than a preset threshold value or not. When the temperature parameter TEMP is larger than the preset threshold value, the selectors 130 generates the driving signal VCOM by selecting one the periodic alternative current signals VAC1-VACM in the group VCOMAC. On the contrary, when the temperature parameter TEMP is not larger than the preset threshold value, the selectors 130 generates the driving signal VCOM by selecting one of the direct current signals VDC1-VDCN in the group VCOMDC. Besides, the preset threshold value is preset by a designer of the driving apparatus 100. The designer may set the preset threshold value by his experience or/and an environment which the EPD panel 140 belonged to.

In this embodiment, each of the periodic alternative current signals VAC1-VACM is corresponded to one of a plurality of first temperature intervals by a first relationship. For example, if all of the first temperature intervals are equal to 5° C., and the preset threshold value is equal to 20° C. The selector 130 may select the periodic alternative current signal VAC1 to be the driving signal VCOM when the environment temperature is between 20° C.-15° C.(=20° C.−5° C.). Moreover, the selector 130 may select the periodic alternative current signal VAC2 to be the driving signal VCOM when the environment temperature is between 15° C.-10° C.(=15° C.−5° C.).

On the other hand, the first temperature intervals may be different. For example, the first temperature interval corresponded to the periodic alternative current signal VAC1 is 7° C., and the first temperature interval corresponded to the periodic alternative current signal VAC2 is 5° C. Then, selector 130 may select the periodic alternative current signal VAC1 to be the driving signal VCOM when the environment temperature is between 20° C. to 13° C.(=20° C.−7° C.). Moreover, the selector 130 may select the periodic alternative current signal VAC2 to be the driving signal VCOM when the environment temperature is between 13° C. to 8° C.(=13° C.−5° C.). In addition, the first relationship of each of the first temperature intervals may be set by the designer, and the first relationship may be fixed or adjusted dynamically when the driving apparatus 100 is operating.

In this embodiment, each of the direct current signals VDC1-VDCN is corresponded to one of a plurality of second temperature intervals by a second relationship. For example, if all of the second temperature intervals are equal to 5° C., and the preset threshold value is equal to 20° C. The selector 130 may select the direct current signal VDC1 to be the driving signal VCOM when the environment temperature is between 20° C.-25° C.(=20° C.+5° C.). Moreover, the selector 130 may select the direct current signal VDC2 to be the driving signal VCOM when the environment temperature is between 25° C.-30° C.(=25° C.+5° C.)

On the other hand, the second temperature intervals may be different. For example, the second temperature interval corresponded to the direct current signal VDC1 is 7° C., and the second temperature interval corresponded to the direct current signal VDC2 is 5° C. Then, selector 130 may select the direct current signal VDC1 to be the driving signal VCOM when the environment temperature is between 20° C. to 27° C.(=20° C.+7° C.). Moreover, the selector 130 may select the direct current signal VDC2 to be the driving signal VCOM when the environment temperature is between 27° C. to 32° C.(=27° C.+5° C.). In addition, the second relationship of each of the first temperature intervals may be set by the designer, and the second relationship may be fixed or adjusted dynamically when the driving apparatus 100 is operating.

Figure 2:
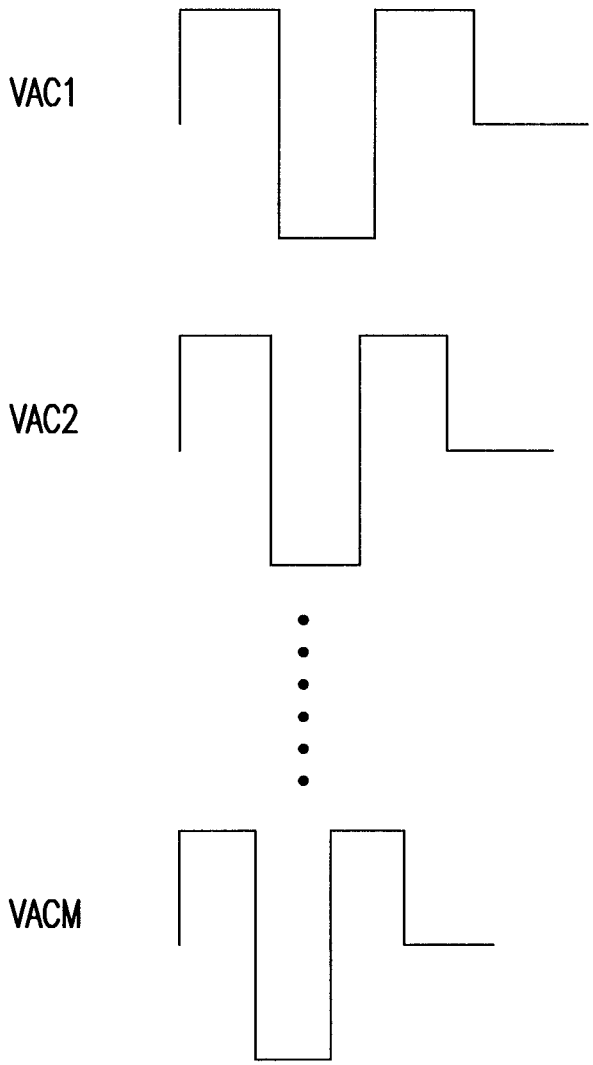
FIG. 2 is a waveform plot of the periodic alternative current signals VAC1-VACM according to an embodiment of the present invention.

Referring to FIG. 1 and FIG. 2, FIG. 2 is a waveform plot of the periodic alternative current signals VAC1-VACM according to an embodiment of the present invention. In FIG. 2, frequencies of the periodic alternative current signals VAC1-VACM are different. That is, when the selector 130 selects one of the periodic alternative current signals VAC1-VACM to be the driving signal VCOM, the frequency of the driving signal VCOM is varied according to the environment temperature.

On the other hand, voltage levels of the direct current signals VDC1-VDCN are different. Therefore, when the selector 130 selects one of the direct current signals VDC1-VDCN to be the driving signal VCOM, the voltage level of the driving signal VCOM is varied according to the environment temperature.

Figure 3:
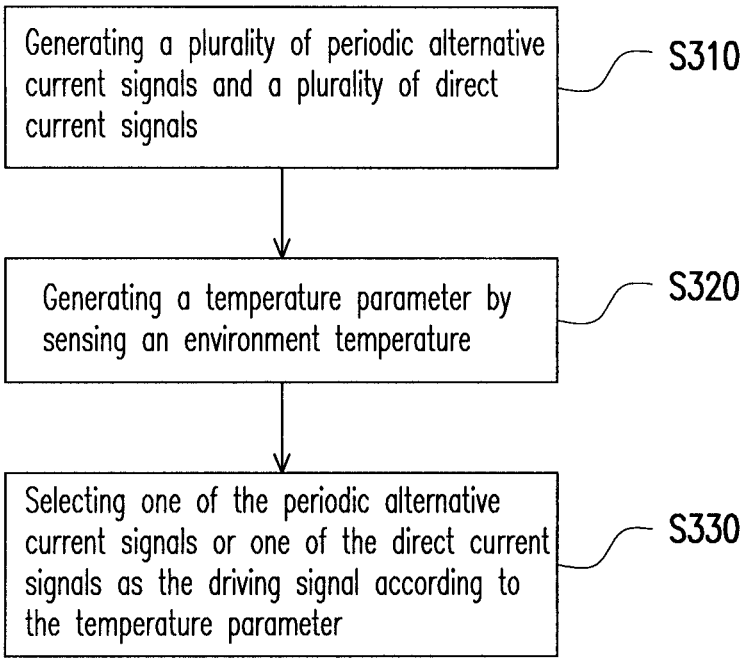
FIG. 3 is a flow chart of a method for generating a driving signal to drive an electro-phoretic display according to an embodiment of the present invention.

Referring to FIG. 3, FIG. 3 is a flow chart of a method for generating a driving signal to drive an electro-phoretic display according to an embodiment of the present invention. The steps of the method for generating a driving signal includes: generating a plurality of periodic alternative current signals and a plurality of direct current signals (S310); generating a temperature parameter by sensing an environment temperature (S320); and selecting one of the periodic alternative current signals or one of the direct current signals as the driving signal according to the temperature parameter (S330).

In summary, the present disclosure provides a selector to select one of one of the periodic alternative current signals or one of the direct current signals as the driving signal according to the temperature parameter. Therefore, the voltage level or the frequency of the driving signal may be adjusted according to the environment temperature, and the performance of the EPD is increased correspondingly.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A driving apparatus for outputting a driving signal to drive an electro-phoretic display, comprising:

a driving signal generator, for generating a plurality of periodic alternative current signals and a plurality of direct current signals;

a temperature sensor, generating a temperature parameter by sensing an environment temperature; and a selector, coupled to the driving signal generator and the temperature sensor, the selector selecting one of the periodic alternative current signals or one of the direct current signals as the driving signal according to the temperature parameter, wherein the driving signal is a common voltage for the electro-phoretic display, and the driving signal is dynamically changed among the plurality of periodic alternative current signals and the plurality of direct current signals in response to the temperature parameter when the electro-phoretic display is in operation, so as to improve a driving time related to the electro-phoretic display and thus increasing the performance of the electro-phoretic display.

2. The driving apparatus according to claim 1, wherein when the temperature parameter is not larger than a preset threshold value, the selector selects one of the periodic alternative current signals as the driving signal.

3. The driving apparatus according to claim 2, wherein frequencies of the periodic alternative current signals are different.

4. The driving apparatus according to claim 2, wherein, each of the periodic alternative current signals is corresponded to one of a plurality of first temperature intervals by a first relationship, and the selector selects one of the periodic alternative current signals as the driving signal according to the temperature parameter and the first relationship.

5. The driving apparatus according to claim 1, wherein when the temperature parameter is larger than the preset threshold value, the selector selects one of the direct current signals as the driving signal.

6. The driving apparatus according to claim 5, wherein voltage levels of the direct current signals are different.

7. The driving apparatus according to claim 5, wherein each of the direct current signals is corresponded to one of a plurality of second temperature intervals by a second relationship, and the selector selects one of the direct current signals as the driving signal according to the temperature parameter and the second relationship.

8. A method for generating a driving signal to drive an electro-phoretic display, comprising:

generating a plurality of periodic alternative current signals and a plurality of direct current signals;

generating a temperature parameter by sensing an environment temperature; and selecting one of the periodic alternative current signals or one of the direct current signals as the driving signal according to the temperature parameter, wherein the driving signal is a common voltage for the electro-phoretic display, and the driving signal is dynamically changed among the plurality of periodic alternative current signals and the plurality of direct current signals in response to the temperature parameter when the electro-phoretic display is in operation, so as to improve a driving time related to the electro-phoretic display and thus increasing the performance of the electro-phoretic display.

9. The method according to claim 8, wherein the step of selecting one of the periodic alternative current signals or one of the direct current signals as the driving signal according to the temperature parameter comprises:

selecting one of the periodic alternative current signals as the driving signal when the temperature parameter is larger than a preset threshold value.

10. The method according to claim 9, wherein the frequencies of the periodic alternative current signals are different.

11. The method according to claim 9, wherein, each of the periodic alternative current signals is corresponded to one of a plurality of first temperature intervals by a first relationship, and the step of selecting one of the periodic alternative current signals as the driving signal comprises:

selecting one of the periodic alternative current signals as the driving signal according to the temperature parameter and the first relationship.

12. The method according to claim 8, wherein the step of selecting one of the periodic alternative current signals or one of the direct current signals as the driving signal according to the temperature parameter comprises:

selecting one of the direct current signals as the output signal when the temperature parameter is not larger than the preset threshold value.

13. The method according to claim 12, the voltage levels of the direct current signals are different.

14. The method according to claim 12, wherein each of the direct current signals is corresponded to one of a plurality of second temperature intervals by a second relationship, and the step of selecting one of the direct current signals as the driving signal comprises:

selecting one of the direct current signals as the driving signal according to the temperature parameter and the second relationship.

* * * * *